US005227106A

United States Patent [19]

Kolvek

[11] Patent Number: 5,227,106

[45] Date of Patent: Jul. 13, 1993

[54] PROCESS FOR MAKING LARGE SIZE CAST MONOLITHIC REFRACTORY REPAIR MODULES SUITABLE FOR USE IN A COKE OVEN REPAIR

[75] Inventor: Robert E. Kolvek, Hamburg, N.Y.

[73] Assignee: Tonawanda Coke Corporation, Tonawanda, N.Y.

[21] Appl. No.: 739,318

[22] Filed: Aug. 1, 1991

Related U.S. Application Data

[63] Continuation-in-part of Ser. No. 478,132, Feb. 9, 1990, abandoned.

[51] Int. Cl.[5] ..... B28B 1/08; C04B 35/60; F27D 1/16

[52] U.S. Cl. ..... 264/66; 264/30; 264/71; 264/332; 264/333; 264/336

[58] Field of Search ..... 264/30, 35, 36, 66, 264/71, 336, 332, 333

[56] References Cited

U.S. PATENT DOCUMENTS

| | | | |
|---|---|---|---|
| 2,476,305 | 7/1949 | Kimmel . | |
| 3,030,687 | 4/1962 | Muspratt | 264/71 |
| 3,296,002 | 1/1967 | Hare | 264/30 X |
| 3,365,318 | 1/1968 | Nameishi | 264/66 |
| 3,561,494 | 2/1971 | Hackett | 264/30 X |
| 3,885,005 | 5/1975 | Downing et al. | 264/66 X |
| 4,086,097 | 4/1978 | Carbonnel | 264/333 X |
| 4,117,055 | 9/1978 | Alexanderson | 264/71 X |
| 4,255,373 | 3/1981 | Kalinin et al. | 264/66 X |
| 4,257,990 | 3/1981 | Thomas et al. | 264/30 X |
| 4,364,798 | 12/1982 | Costa . | |
| 4,452,749 | 6/1984 | Kolvek et al. . | |
| 4,506,025 | 3/1985 | Kleeb et al. . | |
| 4,506,813 | 3/1985 | Dughan et al. | 264/108 X |
| 4,756,355 | 7/1988 | Plowman et al. | 249/109 X |
| 4,859,385 | 8/1989 | Tanaka et al. | 264/66 X |
| 4,895,814 | 1/1990 | Kanzaki et al. | 264/66 X |
| 4,920,899 | 5/1990 | Blundy et al. | 264/30 X |
| 4,921,536 | 10/1988 | Rechter . | |
| 5,106,797 | 4/1992 | Allaire | 264/66 X |

FOREIGN PATENT DOCUMENTS

| | | | |
|---|---|---|---|
| 966512 | 4/1975 | Canada | 264/66 |
| 44052 | 9/1983 | Japan | 264/71 |
| 506468 | 5/1976 | U.S.S.R. | 264/66 |
| 511310 | 8/1939 | United Kingdom . | |

OTHER PUBLICATIONS

"Use of Refractory Modular Shapes in Coke Oven Battery End Flue Repairs", Lauzon et al., I&SM-37, Aug. 1990.

*Primary Examiner*—Karen Aftergut
*Attorney, Agent, or Firm*—John C. Thompson

[57] ABSTRACT

A reconstruction of a heating wall of a coking oven. The reconstruction includes utilization of a novel large size cast refractory repair module which may be utilized to replace existing silica bricks within a coke oven heating wall. The novel large size cast refractory module are monolithic structures formed from a castable refractory material having very high dimensional stability over a wide range of temperatures. Each repair module is a rectangular parallelepiped having one or more vertically extending flues formed therein, one end of a module being adapted to conform to the end shape of the damaged heating wall, the other end of the module being adapted to interfit with existing brickwork. The modules are assembled by initially removing damaged brickwork from the heating wall and then placing in the new modules which are mortared in place. The large size cast modules of the invention are manufactured by selecting a material which when cast will have the desired characteristics, mixing the dry refractory material with a relatively small amount of water, pouring it into a mold on a shaker table and vibrating the mold when filled, and then by firing the cast material after initial set at progressively higher temperatures up to 800 degrees Fahrenheit over a period of almost 60 hours.

5 Claims, 13 Drawing Sheets

PROCESS FOR MAKING LARGE SIZE CAST MONOLITHIC REFRACTORY REPAIR MODULES SUITABLE FOR USE IN A COKE OVEN REPAIR

CROSS-REFERENCE TO RELATED APPLICATIONS

This application is a continuation in part of U.S. application Ser. No. 07/478,132 filed Feb. 9, 1990 by Robert E. Kolvek, now abandoned.

TECHNICAL FIELD

The present invention relates generally to the repair of coke ovens, and more specifically to an improved large size cast monolithic refractory repair module which may be used in the repair of the coke oven, a process for making the large size cast monolithic refractory repair module, and also to a method of repairing at least a portion of a heating wall of a coke oven using the repair modules of this invention.

BACKGROUND OF THE INVENTION

Coke is produced by heating pulverized coal in an air-free environment for a period of time. Typically, coke is produced in a coke oven battery which includes a plurality of side-by-side coking chambers which are separated from each other by heating walls. The side of the coke oven battery where the coke is discharged is called the coke side, and the other side is called the pusher side, the heating walls and the coking chambers extending from one side to the other. In a typical installation the battery may include 40 to 100 or more side-by-side coking chambers, each chamber being from 3 to 6 meters high, typically 14 meters long, and approximately ½ meter wide. There is a slight taper to the width of each chamber so that coal which has been coked within the chamber may be pushed out of the chamber, the width of a chamber at the pusher side being typically 3 inches less than the width at the coke side. Each heating wall is typically built up from a number of horizontally extending courses of silica bricks, the bricks being assembled to define vertically extending flues within the heating walls, which flues cycle between heating and drafting conditions. There may be six bricks or more in each course for each flue. Thus, in a heating wall having twenty-six courses and twenty-eight flues there may be over 4,300 bricks, each brick being location specific.

The coking chamber is normally maintained at a temperature of from 2100 to 2500 degrees Fahrenheit. The coal to be coked is placed (or charged) within the coking chamber through charging holes at the top of each coking chamber During charging and the following coking period, which may be 24 hours long, coke oven doors close off the ends of the coking chamber. While the coking process takes place, gases are driven from the coal, which gases include hydrocarbons such as methane, hydrogen, carbon dioxide, and many others. These gases are typically collected for processing into various by-product chemicals and eventual use as a fuel. The gases driven from the coal initially pass through standpipes which extend upwardly from the roof of the coke oven battery, the gases then being received by a collecting main.

At the completion of a coking cycle, the coke oven doors are removed from both ends of the coking chamber and the coked coal is pushed from the coking chamber by a pusher which is forced entirely through the coking chamber, the coke passing through a coke guide into a quenching car. When the doors are opened, the pressure within the coking chamber will be immediately released and condensed gases or liquor from the collecting main may reverse flow through the standpipe onto the silica bricks causing their surface to spall. In addition, the cold air which rushes in after the completion of the coking operation may also adversely affect the surface of the silica brick, as the silica brick has poor resistance to thermal shock. In any event, after a number of coking cycles over a period of years the surfaces of the silica bricks, particularly at the end of the heating wall adjacent the standpipes, become damaged.

U.S. Pat. No. 2,476,305 discloses that a heating wall in a coke oven may be repaired by replacing individual bricks. A more recent U.S. Pat. No. 4,452,749 also discloses a repair wherein individual bricks are replaced, the bricks in this case being molded from a castable refractory mix which after molding expands to only a neglible degree during heating up from ambient to the operating temperature of the coking oven. However, U.S. Pat. No. 4,452,749 only discloses the use of bricks having essentially the same size as the bricks which they are replacing as it was not known how to cast large refractory shapes until the timely present invention.

It has also been proposed in U.S. Pat. No. 4,364,798 to rebuild a heating wall by removing the damaged brickwork to install forms which will disintegrate when heated, and to then rebuild the removed brick by building up a unitary structure by using a gunning material of the type well known for sealing cracks in coke ovens and for relining furnaces. However, the gunning material proposed has the expansion and contraction properties of the silica brick which it replaces, and it may buckle during expansion and crack during cooling. Accordingly this design has not received any commercial success. Finally, it is conventional practice to simply spray a slurry on the face of the bricks by a gunning application of a refractory gunning material as discussed in Cols. 1 and 2 of U.S. Pat. No. 4,364,798.

Today the only practical method of performing a repair for long-term future service is to knock down the portion of the wall which is to be repaired and to rebuild it with silica bricks or with shapes cast to the shape and form of silica brick as done in U.S. Pat. No. 4,452,749. This process is very labor intensive. In view of the high labor costs involved, as well as the relatively high cost of the silica bricks required, this process is also a very expensive proposition.

OBJECTS AND SUMMARY OF THE INVENTION

It is an object of the present invention to provide a new and improved method for repairing the heating wall of a coke oven, which method employs a novel large cast monolithic refractory repair module made in accordance with the principles of this invention.

It is a further object of the present invention to provide an improved process for manufacturing large size cast monolithic refractory repair modules having a width equal to the width of the heating wall in a coke oven which is to be repaired, a length at least as long as the distance between nozzles and a height at least as high as one course of old brickwork.

It is a further object of the present invention to provide a plurality of large size cast monolithic repair modules having high dimensional stability, which modules can be utilized to repair a heating wall of a coke oven from the floor of the oven to the ceiling of the oven and which may also include specific shapes and forms for the repair of the roof of the oven adjacent the repair.

It is a still further object of the present invention to provide an improved method for assembling the various novel large size cast monolithic repair modules of this invention when repairing the heating wall of a coke oven.

The foregoing objects and other objects and features of the present invention will become more apparent after a consideration of the following detailed description taken in conjunction with the accompanying drawings in which preferred forms of the present invention are illustrated.

Figure 31:
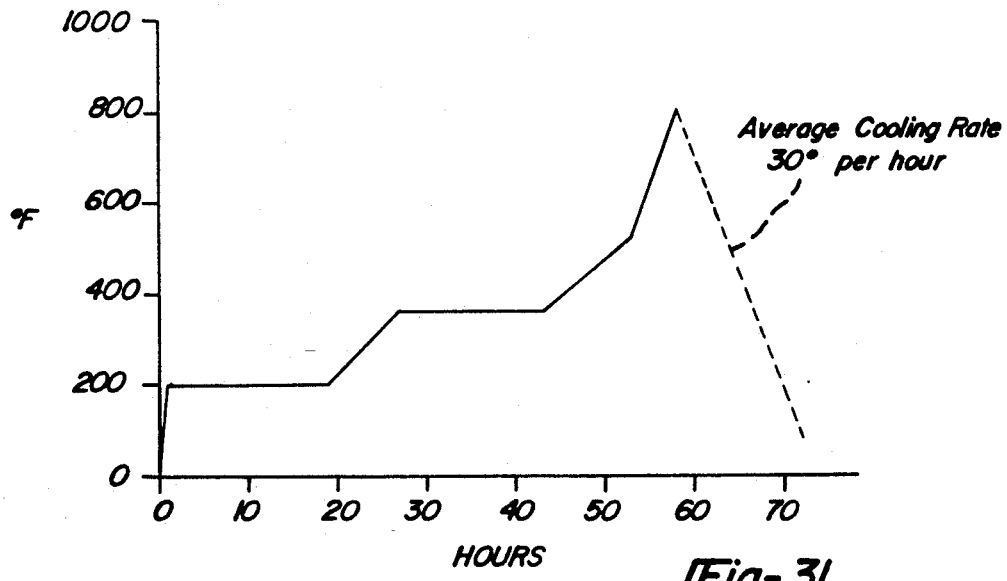

FIG. 31 is a graph showing how the molded material used in forming the various large size cast monolithic refractory repair modules of this invention is fired.

DETAILED DESCRIPTION

In General

Figure 1:
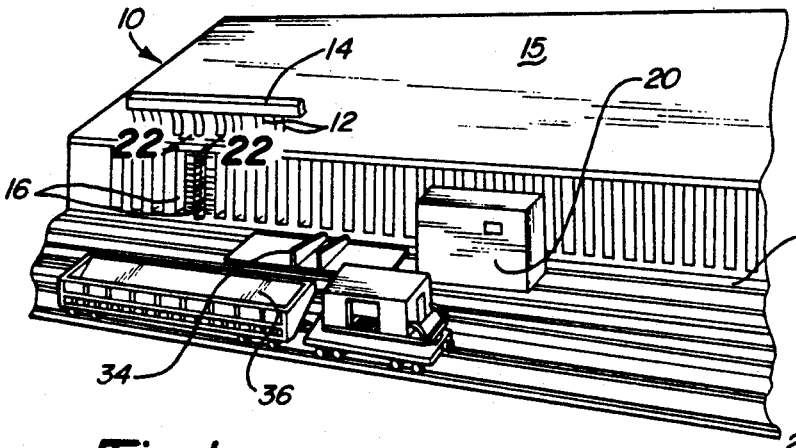
FIG. 1 is a perspective view of the coke side of a coke oven battery which may be repaired in accordance with the principles of the present invention.
Figure 2:
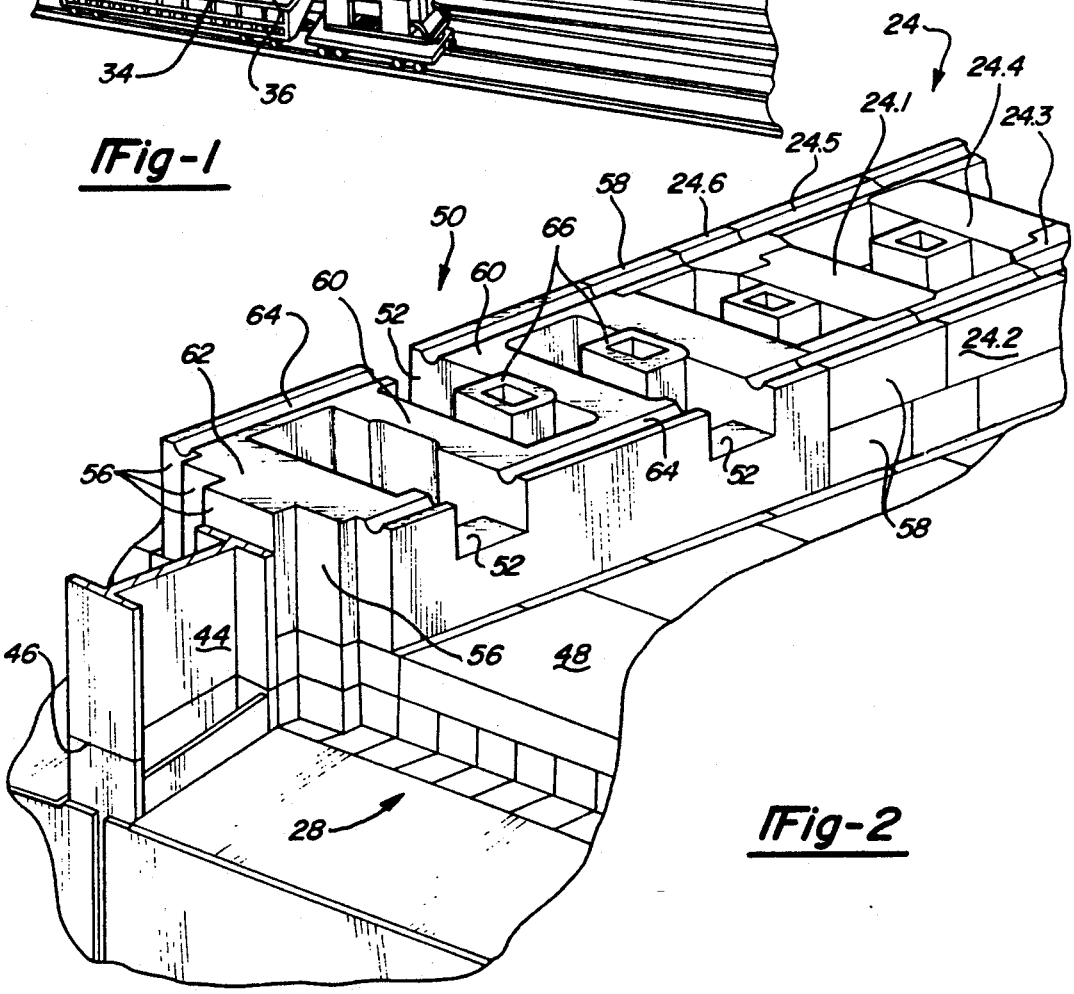
FIG. 2 is a perspective view of a portion of a coke oven illustrating the initial phases of the rebuild of an end portion of a heating wall which extends between two adjacent coking ovens, the old brickwork having been removed and a first large size cast monolithic refractory repair module having been installed over existing floor brick, and also illustrating how the first cast repair module of this invention is tied in with existing silica brickwork when a four flue repair is being performed.
Figure 22:
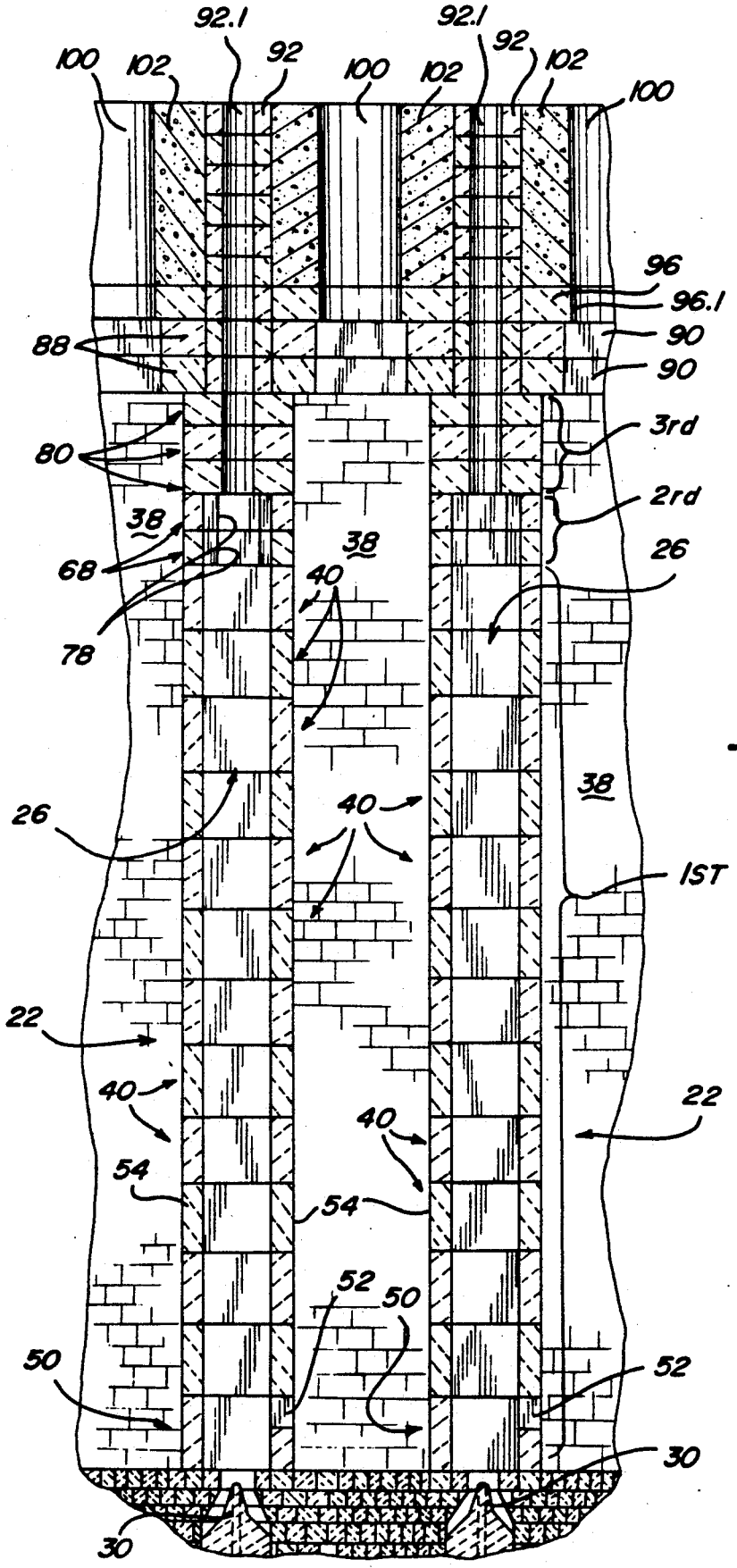
FIG. 22 is a sectional view of a coke oven wherein the end portions of two adjacent heating walls have been repaired as well as the ceiling above the heating walls, this view taken generally along the line 22—22 in FIG. 1.

Referring first to FIG. 1, a portion of a coke oven battery is illustrated, the coke oven battery being indicated generally at 10. The form of a coke oven battery illustrated is sometimes referred to as a by-products coke oven since the volatiles driven off during the coking process flow from standpipes 12 to a collector main 14 for subsequent processing into some of the thousands of different by-products which can be derived from the coke oven volatiles, the standpipe and collector main being mounted on the roof 15. The coke oven battery includes a plurality of coking chambers 16, each of the coking chambers extending the full length of the coke oven battery from the pusher side (not shown) to the coke side 18. Each coking chamber 16 may be 45 feet in length, and also may have a height of 3 to 6 meters, 5 meters being typical. The coking chambers are built with a slight taper, the width at the pusher side being for example 16 inches and the width at the coke side being 19 inches. During coking the chambers 16 are closed by coke oven doors (not shown) which may be removed by a door machine 20. The coking chambers 16 are separated from each other by heating walls indicated generally at 22. Each heating wall is typically formed from courses of silica bricks indicated generally at 24, there being hundreds of bricks to each course. Each of the heating walls is built with a plurality of flues 26, which flues typically are alternated between heating cycles and drafting cycles. The floor of the coking chambers 16 as well as the heating walls 22 are supported by a floor structure indicated generally at 28 (FIG. 2). Heated air and gas are introduced into the flues through nozzles 30 (FIG. 22) and air ports at the bottom of the flues. The air and gas are ignited, the burning gas in turn heating the heating walls to a temperature typically in the range of 2100 to 2500 degrees Fahrenheit.

When the coking cycle for a particular coking chamber is completed, the doors are removed by the door mechanism 20 and then a pusher (not shown) is introduced from the pusher side into the coking chamber to push the coke from within the coking chamber, the coke being discharged through a coke guide, somewhat schematically shown at 34, and then into a quenching car 36.

It should be noted at this point, that the foregoing structure of the coke oven battery and manner of operation of it are well known in the art. A by-product coke oven battery of the type somewhat schematically illustrated in this application is more fully disclosed in GB 511,320.

Figure 4:
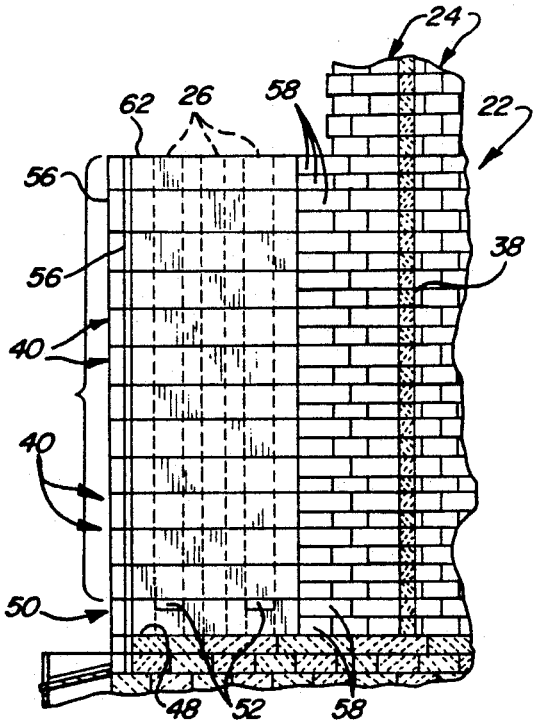
FIG. 4 is a side elevational view of a heating wall having an end portion thereof undergoing repair, the old brickwork having been remove, and 13 cast repair modules of this invention having been installed adjacent the old brickwork in the heating wall, special tie-in face castings being positioned between the modules of this invention and the old brickwork.

An on-going problem in the operation of a by-product coking oven battery is the progressive deterioration of the heating walls between the coke oven chambers. In the past it has been the practice to initially repair a heating wall by spraying the surface with a suitable slurry of sprayable refractory gunning material. While this will slow down the deterioration of the wall surfaces of the coking chamber, eventually it will be necessary to rebuild at least an end portion of the heating wall. This is done by shutting off the air and gas flow to the heating wall so that there is no combustion within the flues, to insulate the area which is to be repaired by placing bulkheads 38 (FIGS. 4 and 22) in the two coking chambers to either side of the heating wall which is to be repaired, and to place wall insulation (not shown) on the surface of the adjacent heating walls. The damaged bricks are replaced with new silica bricks. Because of the large number of bricks which are employed in a heating wall, this is a very time-consuming process, typically taking approximately 2 to 3 weeks to complete.

Recently new silica-based mixes have been developed, one of which is the subject of U.S. Pat. No. 4,506,025. This mix has been proposed for use as a replacement of silica bricks. See also U.S. Pat. No. 4,452,749 which disclosed the use of a similar mix for refractory repair.

Figure 5:
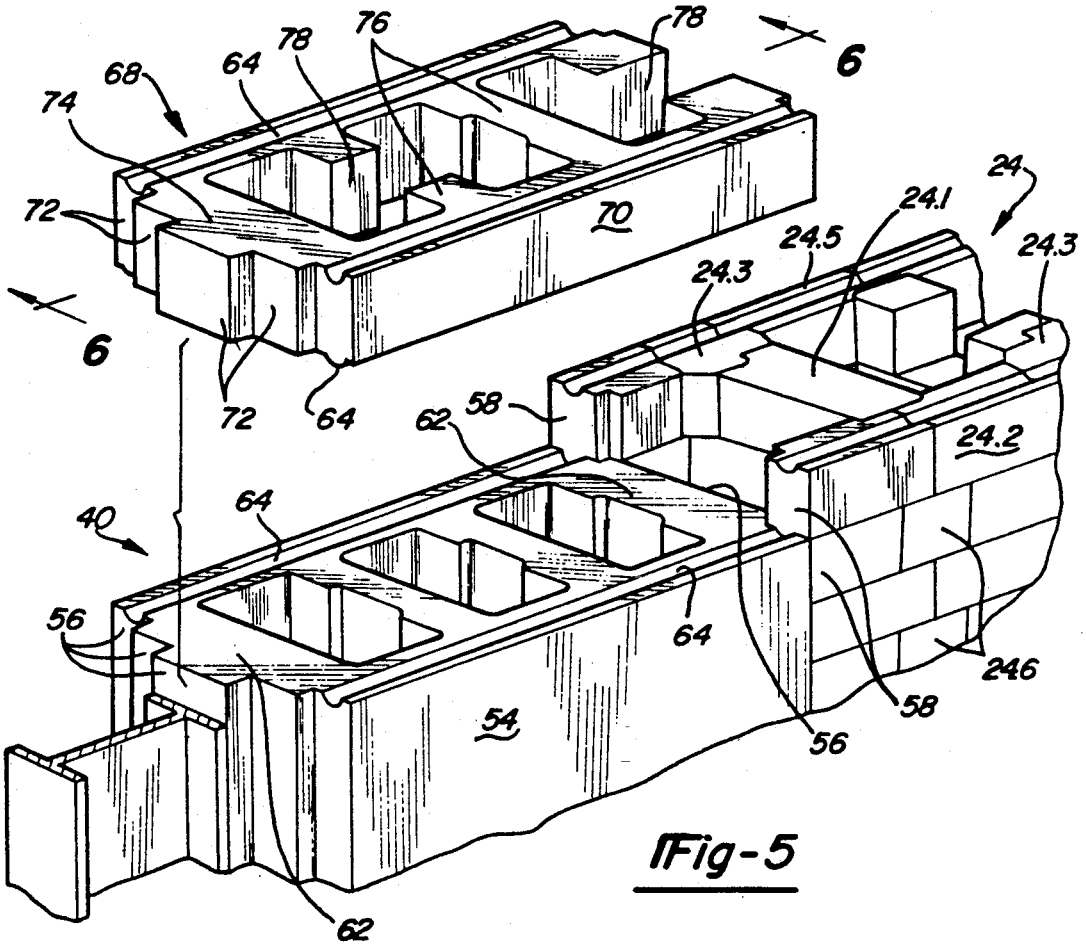
FIG. 5 is a view similar to FIG. 3 but showing a further form of a large size cast repair module of this invention which is to be mounted on the prior cast repair modules shown in FIG. 4, the form of cast repair module shown in FIG. 5 having partition walls between adjacent flues removed so that gases within one flue can flow into another flue.
Figure 6:
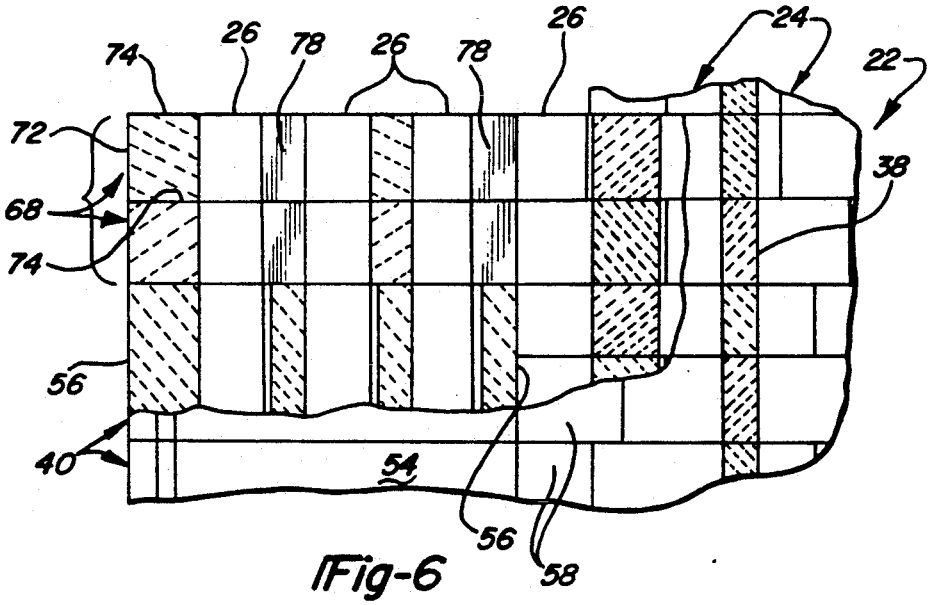
FIG. 6 is an enlarged side elevational view of the upper portion of the repair, portions being broken out to facilitate an understanding, the sectional portion of this figure being taken generally along the line 6—6 in FIG. 5.

It should be appreciated that even though this mix, after casting has high dimensional stability and good thermal shock resistance in the temperature ranges which may be encountered by a silica brick within a coke oven, the large number of bricks which would have to be utilized would still require an exensive repair time. In addition, it will be necessary to very carefully mortar the many adjacent surfaces of the bricks if made in a conventional design, such as that shown to the right in FIGS. 3, 5, and 7.

In accordance with this invention a novel large size cast monolithic refractory repair module is formed from a refractory mix of the type which, when set and fired, has a high dimensional stability and good thermal shock resistance in the range from 0 to 2850 degrees Fahrenheit. The cast refractory module of this invention encompasses at least one entire flue from one side of the heating wall to the other side. The large size, repair module preferably encompasses two or more flues. Thus, in accordance with this invention, a variety of novel cast repair modules are provided for use in the repair of heating walls between coke oven chambers.

Process for Making Large Size Cast Modules

Figure 3:
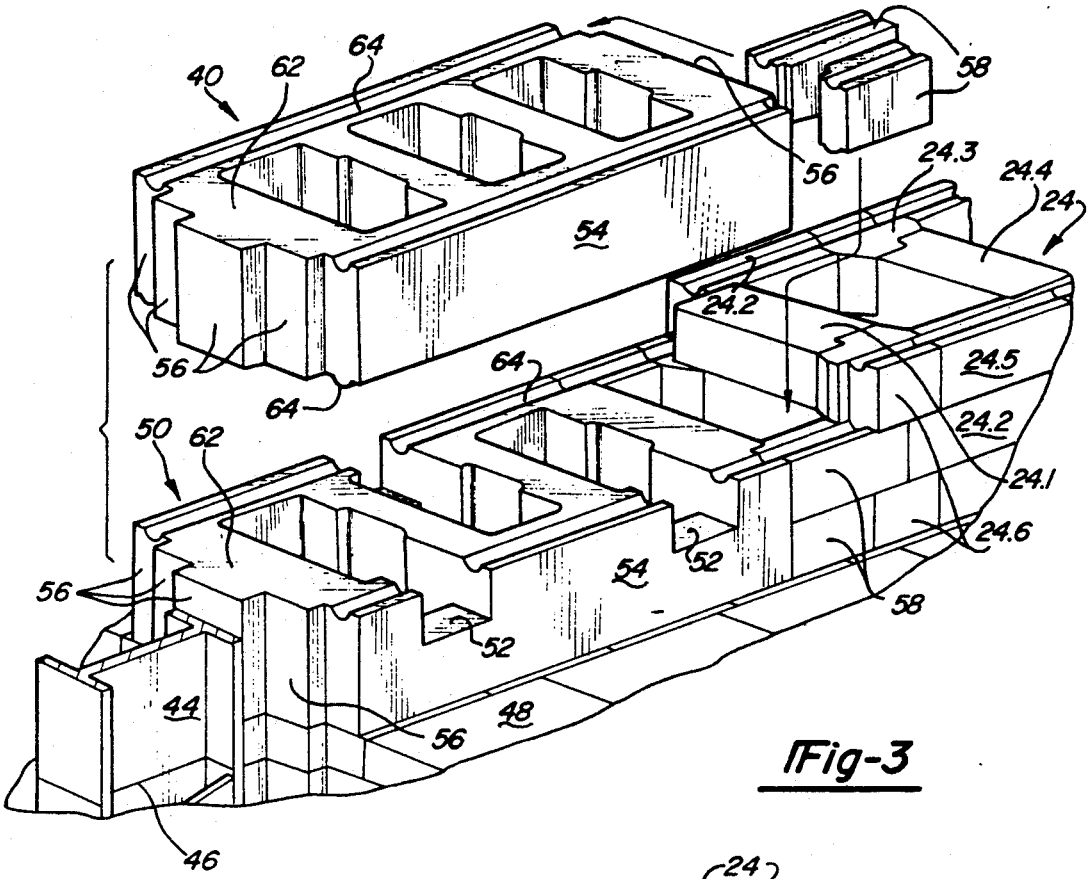
FIG. 3 is a view similar to FIG. 2 but illustrating a second large size cast repair module in position above the first cast repair module shown in FIG. 2.
Figure 27:
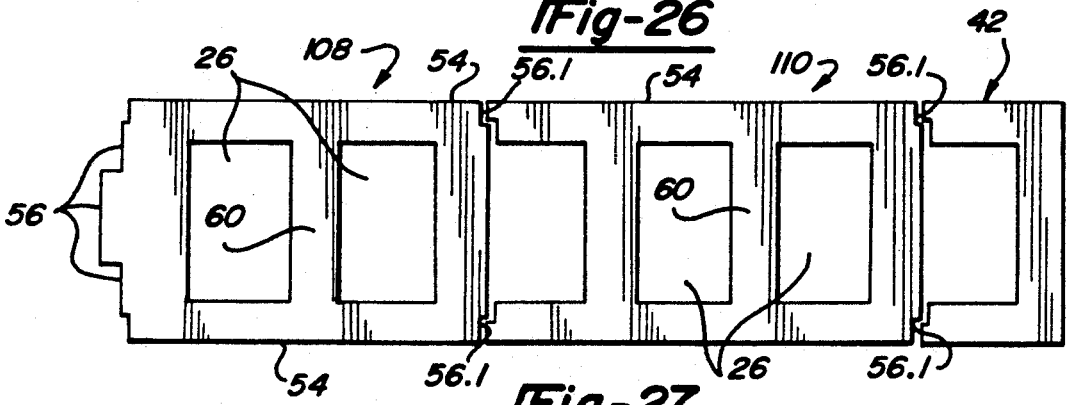
FIG. 27 shows a stagger block arrangement for the nine flue repair wherein three separate large size cast repair modules are utilized to create a six flue configuration.
Figure 25:
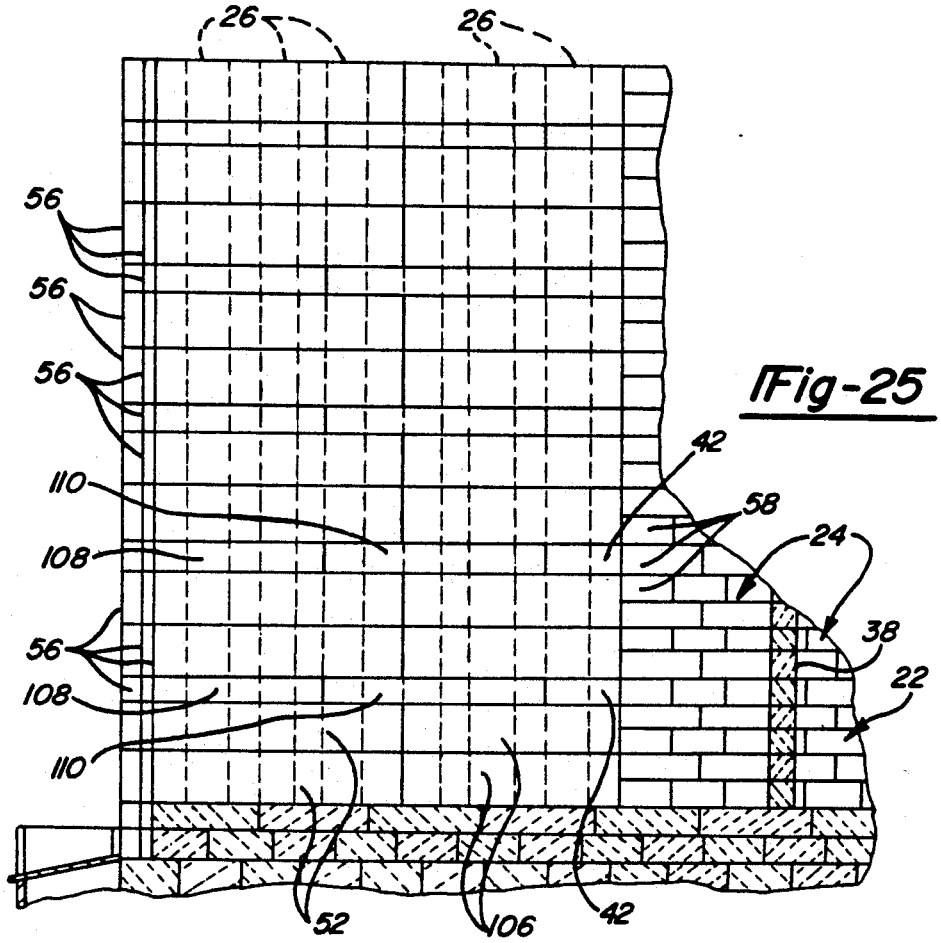
FIG. 25 is a side elevational view showing a seven flue repair with tie-in face castings used for the seventh flue.

With reference now to FIG. 3, a first large size cast refractory repair module made in accordance with the principles of the invention is indicated generally at 40. A large size cast module for the purposes of this application is one that has a width of at least 14 inches, a height of at least 5.5 inches, and a length of at least 14 inches, the smallest large size cast module contemplated by this invention being indicated at 42 in FIGS. 25 and 27. The first cast repair module 40, shown in FIG. 3, is considerably larger than the minimum sizes of a large size cast repair module set forth above. Although it has a width only slightly larger than that specified, it has a height approximately twice the height specified, and a length approximately 3 times the size specified. In any event, in the past it has generally been agreed that it has not been practical to put large size cast modules into service in a coke oven as they will fail for a variety of reasons, either by exploding when they are heated to the operating temperatures of the coke oven, or for other reasons, some of which are lack of abrasion resistance, poor compressive strength, slumping, as well as others. However, it has been found through extensive experimentation that it is possible to make such large size cast modules. Two separate processes using different starting mixes are set forth below. The specific chemistry of the mixes set forth below are not known at the present time.

One mix used for making blocks which has the desired properties, namely a thermal expansion of less than 0.5%, good compressive loading, and a service range of up to 2850 degrees is a dry refractory mix sold by Harbison Walker under the trademark of Descon 97S, which dry mix is believed to be made in accordance with the principles set forth in U.S. Pat. No. 4,506,025. Castings made from this dry mix have good abrasion resistance to coke as it is being pushed past its surface. The mix, as received from the manufacturer, presents several variables that have to be checked. This can make the difference between making a block that can be properly "fired" in a firing oven and used for an extended period of time in a coke oven, and one that fails during firing or after installation in a coke oven. The inventor and the foreman in charge of the module making are not sure whether this is due to variables in the mixing of the ingredients of the mix by the manufacturer, or if it has to do with variations of the ingredients used by the manufacturer, Harbison, or both.

The mixer at the module or block making site is cleaned out to bare metal at the end of the day for the next day. There is no cleaning necessary between batches. Thus several block molds are filled in the course of one day without cleaning the mixer between batches.

Four 55-pound bags of the mix are first mixed dry in the mixer for one minute. This is the capacity of the mixer at the present site. This combines the mix into an even dry mix with no segregation. The dry mix time is not allowed to exceed one minute 10 seconds, as above this time, some of the fine ingredients, such as wicking, could be lost into the air. This could result in block failure.

Mixing is continued with the water being added next. The normal starting point is 56 ounces of water per bag. Normal wet mixing time is 5 minutes. It can be as short as 4 minutes and as long as 7 to 8 minutes. The mixed material is dumped into a receiving pan. The mixed material is then shoveled by hand into the mold. When the first mixed material is added to the mold, the mold is vibrated on a vibrating table. Vibration is continued until the mold is completely filled with additionally mixed material. It will take at least three more batches from the mixer, twelve bags, to fill the block mold for the casting 40. It may be necessary to make additional mixed material from one or two bags to completely fill the mold. A floating trowel is used to smooth and level the mixed material in the mold while vibrating. Vibration is stopped when the mold is full and the mixed material leveled. The vibrating table is made of ½-inch plate steel supported by Airmount agitators. The vibrator is sized to impart to the table suitable vibration. A 1 ½ horsepower vibrator, capable of imparting 3,600 impacts/minute using a 1,500-pound force vibrator, has been found to be satisfactory.

The amount of water added to the dry mix is critical. The normal starting point is 56 ounces. If the initial mixed material appears to be too wet on vibrating in the mold, the next batch will have 2 to 4 ounces less water added to the dry mix. If it is still found to be too wet, there is a fault in the dry mix. If the initial mixed material is found to be too dry, up to 2 ounces of additional water may be added. Again, above this point indicates a problem with the dry mix as furnished by the supplier. The addition or deduction of water is a judgment made by the foreman. This is done by observing the rise of water in the first batch shoveled into the mold upon initial vibration. The water tends to rise through the mixed material. A feel of the mixed material in the mold is also used in making this judgment. This is an experience factor that the foreman uses. The weight of the bags has been found to vary as much as 2 pounds in a 55-pound bag. Appearance of the mixed material in the mold should be a gray color. If it is a blue gray, it indicates an improper dry mix as furnished by the supplier. Experience has taught that the blue-gray blocks do not "fire" properly. There is a wicking ingredient used in the dry mix to help moisture escape upon drying and "firing". If this tends to wad up into a ball, resembling a cotton ball, the dry mix is rejected. The block will explode or break when "fired.".

The method of mixing and molding this mix for the large shapes being made is different than the manufacturer suggests. The manufacturer has not been successful in making large shapes with his own mix. This is a development of the inventor.

After the mixed material within the mold has taken an initial set, the mold is stripped from the cast or molded material and then the block of molded material is placed in a firing oven where it is progressively heated through the stepwise gradient shown in FIG. 31. Thus the firing is commenced by initially bringing the temperature of the molded material from ambient to a temperature slightly below the boiling temperature of water (200° Fahrenheit), the molded material being held at this temperature until the temperature within the molded material is stabilized for a period of time, this step taking approximately 19 hours from the commencement of firing. The temperature of the molded material is then progressively raised for 8 hours to a temperature of 360° Fahrenheit at a rate of approximately 20 degrees Fahrenheit per hour. 360° F. is about 150° F. above the boiling temperature of water but below the temperature at which the molded material is sintered or ceramically bonded. When the molded material attains a temperature of 360° Fahrenheit, it is then held at this temperature for a further 16 hours, a time sufficient to drive out all free water. The temperature of the molded material is progressively raised during the next 10 hours to a temperature of 520° Fahrenheit at a rate of approximately 16 degrees Fahrenheit per hour. Then the temperature of the molded material is progressively raised to a temperature of 800° Fahrenheit during a period of 5 hours to form the large size cast refractory of this invention. When the heating or firing cycle has been completed, the large size cast structure is then cooled at an average cooling rate of 30 degrees per hour until it attains ambient. However, other cool down rates may be used. The large size cast refractory repair module is now ready to be installed.

Another refractory castable dry mix which may be used for forming large size cast refractory modules is manufactured by the Chicago Firebrick Company and sold under the trademark of Free Kast 896. According to the packaging which accompanies this material, it is manufactured under U.S. Pat. No. 4,921,536. This material is received from the supplier in 50-pound bags. The mix is mixed in a clean mixer which has been wet with a pail of water, the water having been dumped prior to the starting of the mixing operation. Water for the mix is added to the mixer with the mixer on, 46 ounces of water being used per bag of mix. (The mixer being used at the present time can accept only three bags of mix.) Three bags of the Free Kast 896 mix are then added to the mixer with the water. IF too dry or wet, only 2 ounces of water is added or deducted to adjust the mixing moisture for future mixed batches. The mold which is being used to form the large size cast refractory repair module of this invention is completely filled with mixed material before vibrating. Vibration time of the mold is not as critical as with Descon 97S. Normally, the filled mold is vibrated for the length of time that it takes to smooth and trowel the mixed material in the mold. Thus, as the mold may take up to twelve bags of mixed material, it is necessary to continue to fill the mold until a sufficient fill has been achieved. If the mixed material was too wet to start out with, it has been learned that putting the mold with the mixed material in it into a drying oven over night will prevent cracking of the casting or molded material when subsequently handled. The mold is removed after the molded material is removed from the drying oven. Wood molds are used for some of the castings. After the mold has been stripped from the molded material or block, the block can go directly to the firing oven, or it can go into storage until the firing oven is ready for a group of blocks. The firing process for this material is the same as for the Descon 97S material. The method of mixing and molding of this mix for the shapes being made is different than the manufacturer suggests and incorporates the thoughts of the inventor.

Four Flue Repair

Reference will now be made to FIGS. 2 through 22 which illustrate the process for making a four flue repair as well as various special shapes of the large size repair modules used for rebuilding the heating walls between adjacent coking chambers, various special shapes of large size cast repair modules used for the ceiling repair and the flue modules which extend to the top of the roof 15 of the coke oven battery. When making a four flue repair of the type shown, a number of preliminary steps are made which are not illustrated in the drawings as these are conventional steps used in any coke oven end wall repair. Thus, the coke oven doors and coke oven door frames are removed at the ends of the adjacent coking chambers where the end wall repair is to be performed. The repair area is insulated by building a brick bulkhead 38 which extends between existing brickwork across the width of the heating chamber. In addition insulation is applied to the side walls of the heating walls to either side of the coking chambers. Also, for convenience in the repair and to facilitate the introduction of the large size repair modules into the area to be repaired, the buckstay 44 at the end of the heating wall is cut off at the floor level as indicated at weld line 46 and the portion above the line 46 through the roof 15 is removed. While the buckstay is shown in FIGS. 2, 3, and other figures, it is only being illustrated for reference purposes to show how the ends of the new repair will engage the buckstay when the parts are reassembled. After the steel work has been removed, it is then only necessary to remove the old brickwork in the area to be repaired, the brickwork being removed to the level of the floor of the coking chamber. In the repair shown in FIGS. 2 through 22, the roof portion above the heating walls is removed. However, this is not essential. The old brickwork 24 comes in a variety of shapes. Typically, six separate bricks are used in each course to build the brickwork around a flue, these differing specific shapes being indicated at 24.1, 24.2, 24.3, 24.4, 24.5, and 24.6 in FIG. 3. It should also be noted that as the coke over chamber has a 3-inch taper, being 3 inches wider at the coke side than at the pusher side, it is also necessary to dimension these bricks to take into account the taper of the coking chamber. As can also be seen, every other course is different to provide for stagger of the silica brick shapes. In any event, the old brickwork which is to be repaired is removed so that only brickwork necessary to define one side of the fourth flue is left in place, which for the top course of old brickwork illustrated in FIG. 3 are the various shapes shown. Finally, it will be necessary to plug off the gas nozzles 30 and air vents where the old brickwork has been removed to prevent any mortar from falling into the nozzles and plugging them up.

Figure 26:
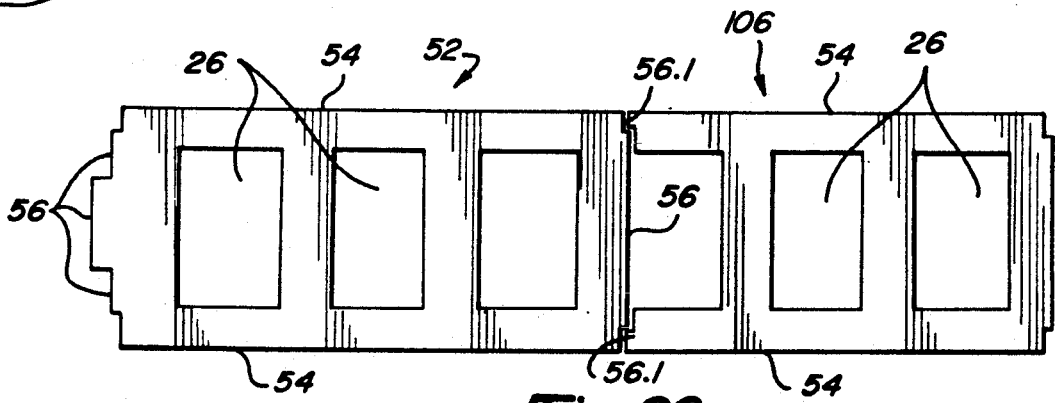
FIG. 26 is a plan view of two adjacent large size three flue cast repair modules used in the seven flue repair shown in FIG. 25.

In the four flue repair shown in the drawings, which is being applied to a coking chamber for a coke oven battery having 5 meter high coking chambers, 13 large size cast refractory repair modules 40 of a first generally identical configuration are employed. The difference between the first 13 modules is that the bottom first large size cast refractory repair module 50 is provided with cleanout ports 52 whereas the other first large size cast refractory repair modules 40 are not provided with cleanout ports. In all other respects the modules 40 and 50 are the same. Thus, as can be seen from an inspection of FIGS. 2 and 3, each of the modules is formed of a structure which is of a generally rectangular parallelepiped form having first and second opposed vertically extending side walls 54 which are spaced apart from each other a distance substantially equal to the width of the heating wall being repaired at the location of the repair. Two cleanout ports are provided in one of the side walls 54 and an additional cleanout port is provided in the other side wall 54. The structure further includes first and second opposed generally vertically extending ends 56. The end 56 which is adapted to abut against a buckstay has the specific shape illustrated best in FIG. 26. The other end 56 is adapted to be placed into contact with the tie-in face castings 58 to form the fourth flue, the other end being of the shape illustrated. Partitions 60 extend from one side wall 54 to the other to define with the ends 56 three flues 26. As can be seen from FIG. 26 casting 40 (as well as the castings 50), are provided with notches 56.1 which may cooperate corresponding notches in the tie-in face castings 58 to prevent the flow of gases between the coking chamber 16 and the fourth flue adjacent the right-hand end (as illustrated) of the large size cast repair module. In addition, the large size cast repair module is provided with upper and lower generally horizontal surfaces 62. The distance between the horizontal surfaces is at least equal in all large size cast repair modules to one course of old brickwork, and in the preferred form of the first large size cast modules illustrated in the FIGS. 2, 3, and others, the vertical distance is equal to 2 courses of old brickwork. It can be seen from an inspection of these figures that one large size cast repair module of the type utilized in a four flue repair will replace 36 silica bricks. As the flue space is typically totally enclosed or at most, where the tie-in blocks are used, has 2 vertical passageways, the design has been found to substantially reduce coke oven battery emissions. The top and bottom surfaces are provided with matching tongue-and-groove surfaces 64 to further reduce the possibility of emissions. However, it should be noted that this design is considered conventional. As is conventional, air pipes are provided within the bottom 48 and 54 inches of the flues 26.

The large size cast repair module is made from a mix which has high dimensional stability, negligible expansion on heating, good compressive strength, and good thermal shock resistance in the range of 0 to 2850 degrees. In addition, when cast, the surface of the large size module should be resistant to abrasion such as may be present during the push of coke from the coking chamber at the end of the coking process. While such mixes are readily available, it has not been practical in the past to cast large size modules such as the type shown at 40 and 50 as prior experience has shown that such modules will fail when placed in the oven or, more likely, will fail during the initial firing by either cracking or exploding. However, the smaller shapes, such as the tie-in face castings 58 may be made by conventional molding and firing practices such as the type recommended by the manufacturers of the mix used, for example by the manufacturer of the Harbison Walker Descon 97S mix. When the repair is made, it is typically necessary to cut the tie-in face castings to size on the job site. When this is done, a compressive mortar is placed between the joint formed between the tie-in face casting 58 and the old brickwork 24 as the old brickwork will expand when the end of the oven is brought back up to coke oven temperatures after repair and this expansion must be accommodated at this location. However, as the large size cast module 40 or 50 will not expand an appreciable amount and as the tie-in face castings 58 will also not expand an appreciable amount, the brick layer need only be concerned with the expansion of the silica brick.

After an appropriate number of first large size cast repair modules have been laid in place, which number will be dependent upon the size of the battery being repaired, it is necessary to provide a second large size cast repair module which is a transitional module utilized to cause the flue gases to flow from one flue to another. This is done because in coke oven design flues are alternately used between heating cycles and drafting cycles. In the form of coke oven repair being illustrated in these drawings, a hairpin design is illustrated where one flue is used for heating and the immediately adjacent one is used for drafting. However, other flue designs are well known in the art. In any event, it is necessary to provide a second design of large size cast repair module for use at the top of the flues, the second large size cast repair module being indicated generally by reference numeral 68. In the design illustrated, two large size cast repair modules 68 are employed. Each of these modules has a bottom to top surface distance equal to only one course of old brickwork. The second large size cast repair module 68 will be made preferably from the same mix as the first one 40, but it may also be made from another mix which has same abrasion resistance as the mix for the first large size cast repair modules 40. Thus, as the second large size cast repair module 68 will not be above the coke surface, it will be subject to abrasion during a push. The second large size cast repair modules also have first and second opposed vertically extending side walls 70 which are spaced apart from each other the same amount as the side walls of the first large cast repair modules upon which it sits. It also has first and second ends 72 and upper and lower horizontal surfaces 74. As previously noted, in the design illustrated the distance between the horizontal surfaces 74 is equal to only one course of brick. As can be seen from an inspection of the figures, the second cast repair module follows the same design as the first cast repair module except that its height is ½ of that of the first repair module and also in that every other partition wall 60 is removed as at 78 to provide a passageway for gases between adjacent flues.

Figure 7:
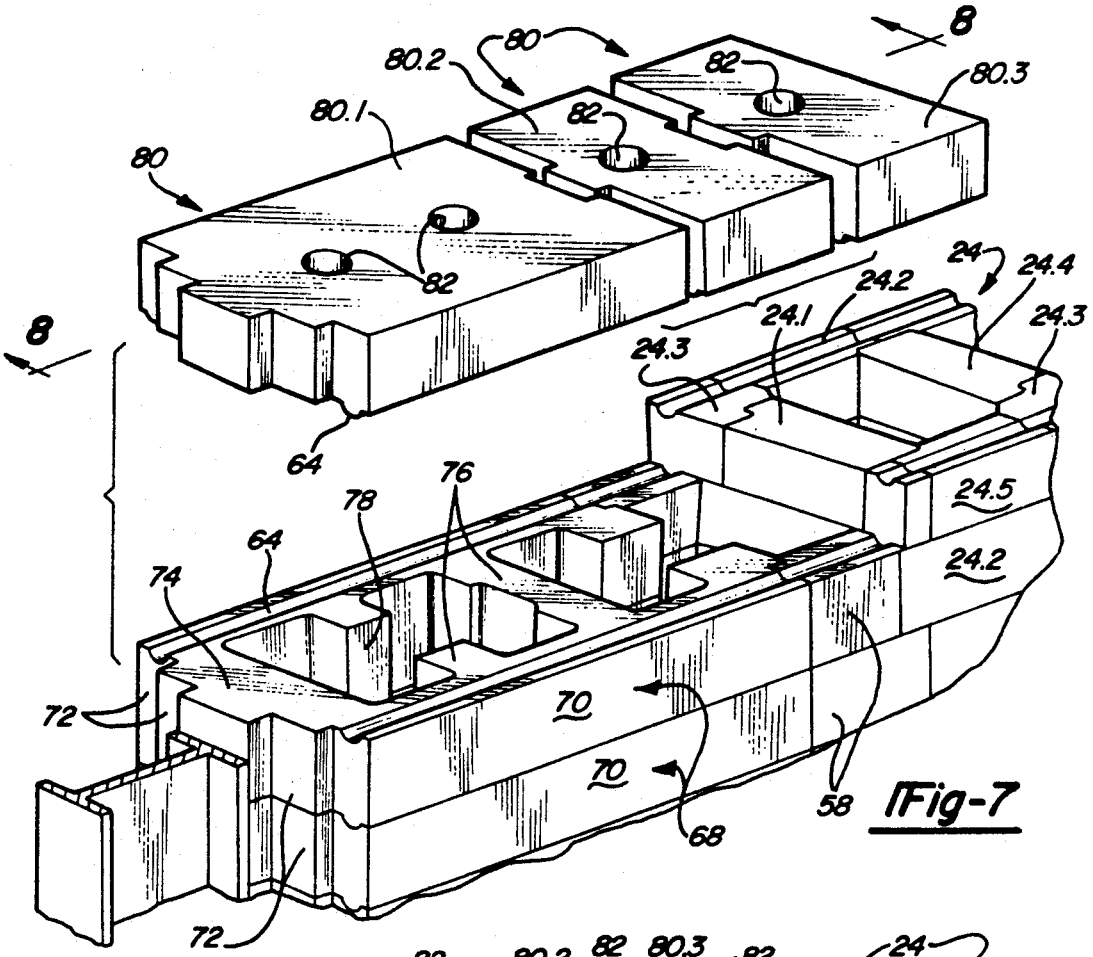
FIG. 7 is a perspective view similar to FIGS. 3 and 5 but illustrating a further form of a large size cast repair module, which form is utilized to close off the tops of the flues with the exception of flue inspection holes.
Figure 8:
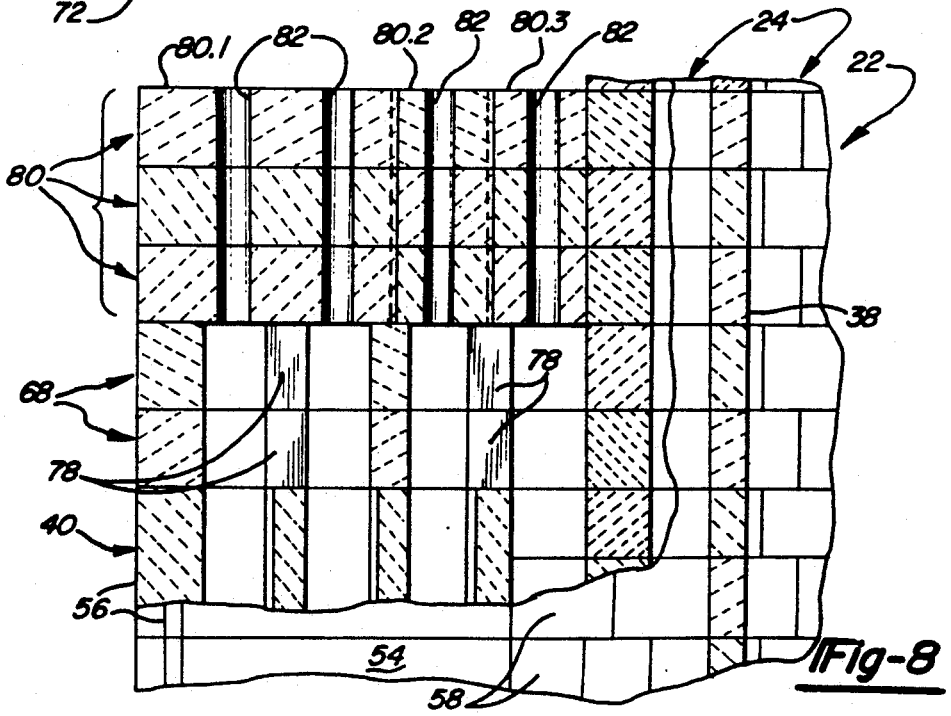
FIG. 8 is a side view similar to FIG. 6 but illustrating the structure therein after inspection port modules illustrated in FIG. 7 have been added, the sectional portion of this figure being taken generally along the line 8—8 in FIG. 7.
Figures 9, 10:
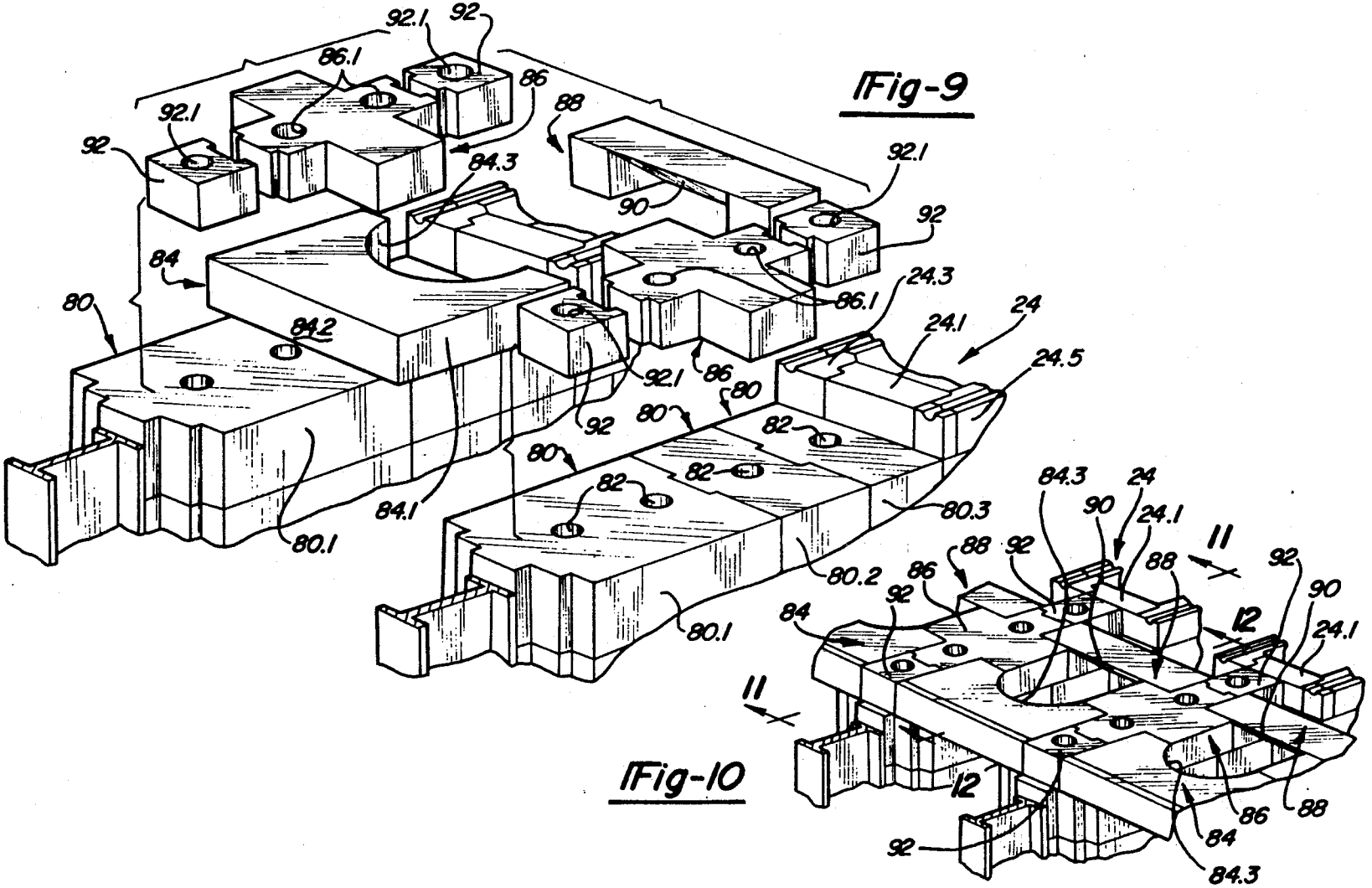
FIG. 9 is a perspective view of two adjacent heating walls which have been repaired to the extent illustrated in FIG. 8 and further showing a first set of cast interfitting ceiling repair modules which are utilized to perform a ceiling repair, the first set of ceiling repair modules being shown in exploded form.
FIG. 10 is a view similar to FIG. 9 but showing the first set of ceiling repair modules assembled onto the repair modules shown in FIGS. 8 and 9.
Figure 11:
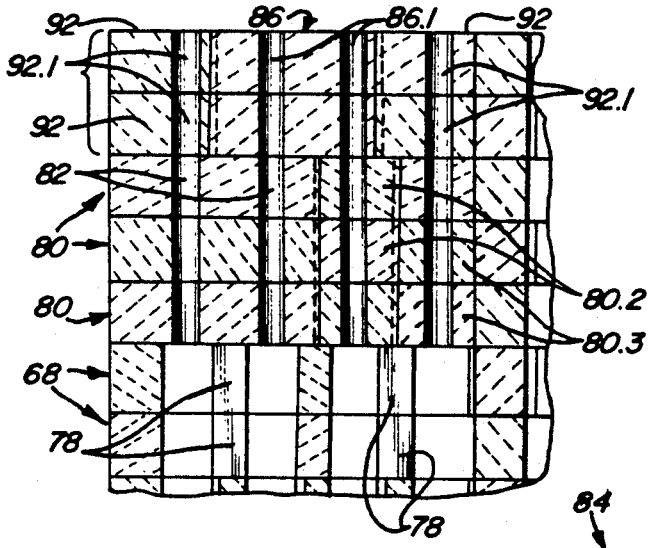
FIG. 11 is a sectional view taken generally along the line 11—11 in FIG. 10.
Figure 12:
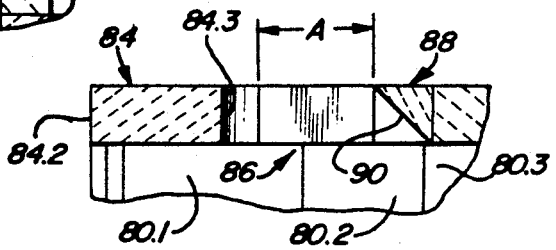
FIG. 12 is a sectional view taken generally along the line 12—12 in FIG. 10.
Figure 14:
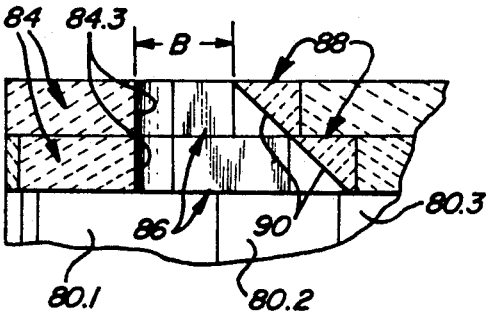
FIG. 14 is a sectional view taken generally along the line 14—14 in FIG. 13.
Figure 13:
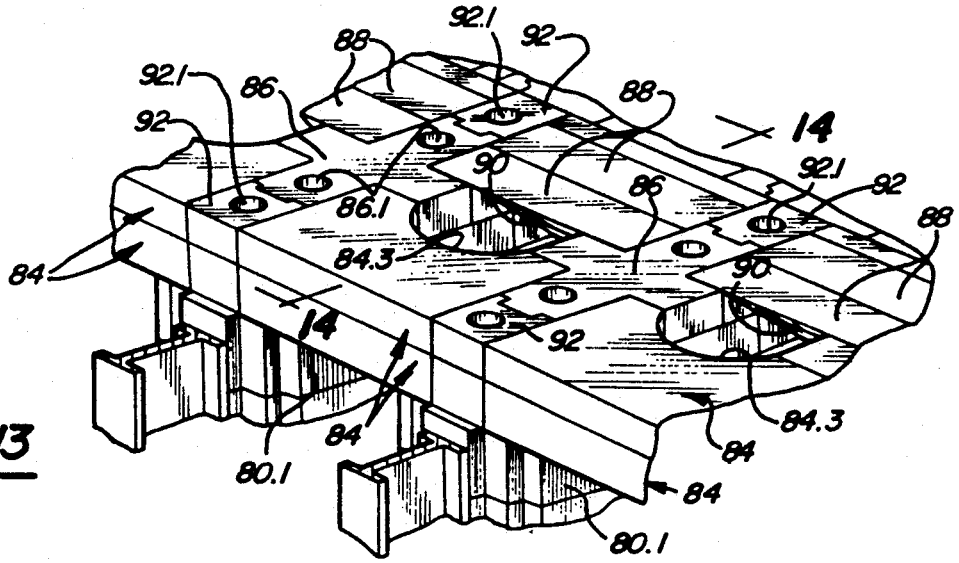
FIG. 13 is a view similar to FIG. 11 but showing a second course of the ceiling repair modules shown in FIG. 9 added to the structure shown in FIG. 10.
Figure 15:
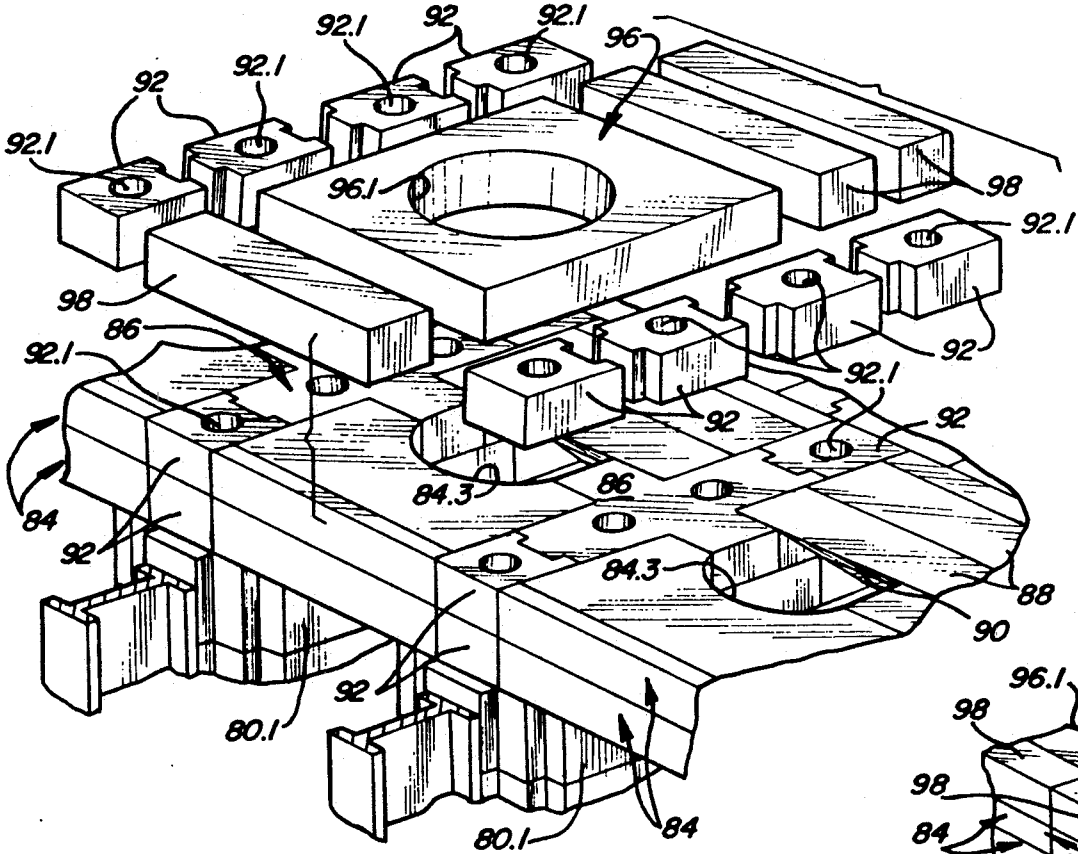
FIG. 15 is a view similar to FIG. 9 but showing in exploded view of a second set of interfitting ceiling repair modules which are to be added to the structure shown in FIG. 13.
Figure 16:
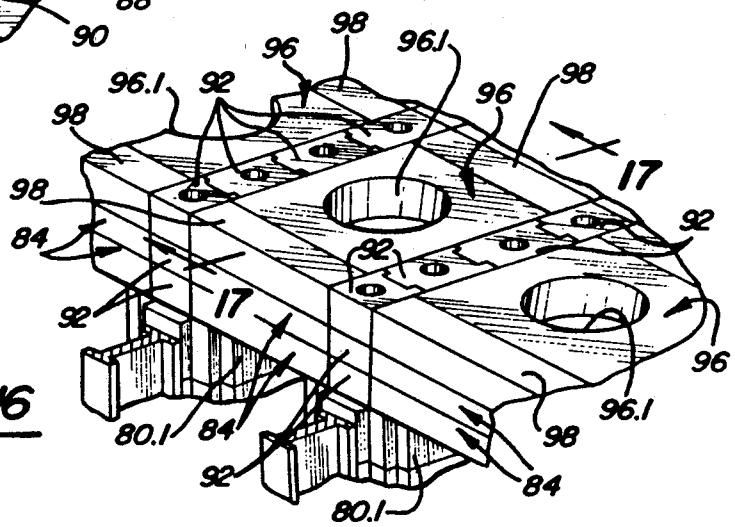
FIG. 16 is a view similar to FIG. 13 but showing the course of modules illustrated in FIG. 15 assembled to the structure shown in FIG. 13.
Figure 17:
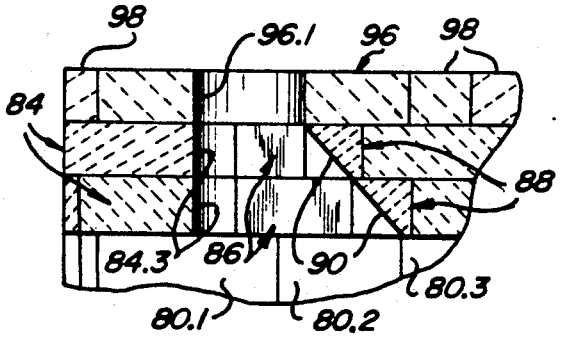
FIG. 17 is a view taken generally along the line 17—17 in FIG. 16.
Figure 18:
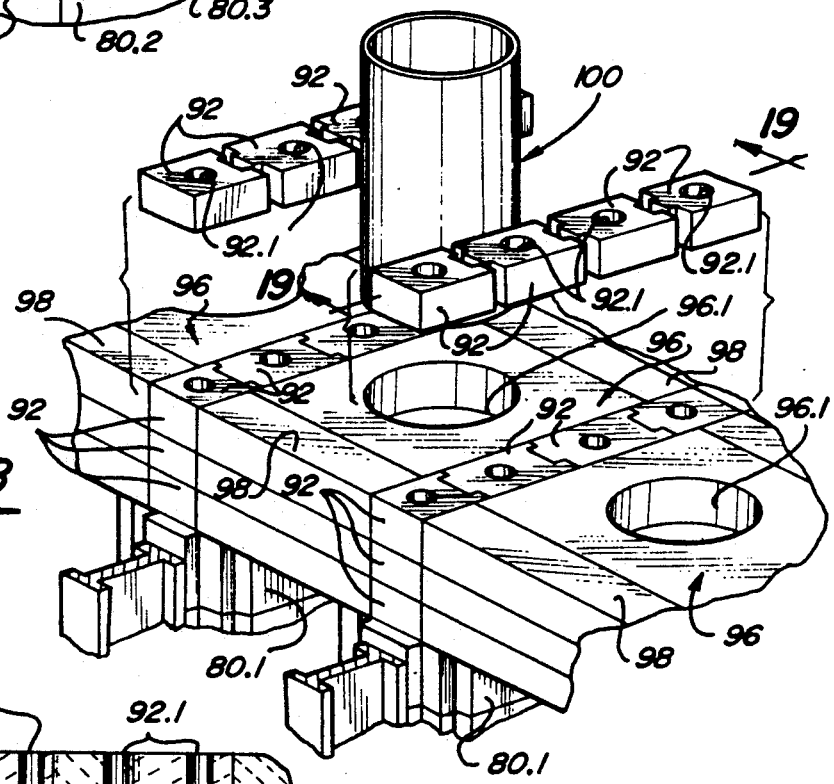
FIG. 18 is a further perspective view illustrating in part the manner in which the roof of the coke oven is repaired, this view illustrating additional inspection port castings being added to the structure shown in FIG. 16 and further showing a fiber tube which will be utilized in the formation of a gas off-take which will in turn be connected to a standpipe.
Figure 19:
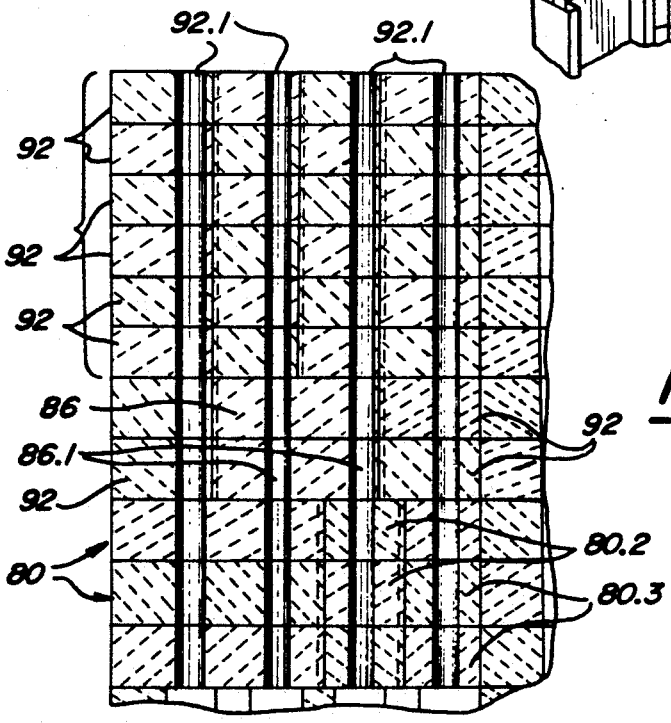
FIG. 19 is a sectional view taken generally along the line 19—19 in FIG. 18 but further showing a plurality of inspection port castings assembled onto the roof structure.
Figure 21:
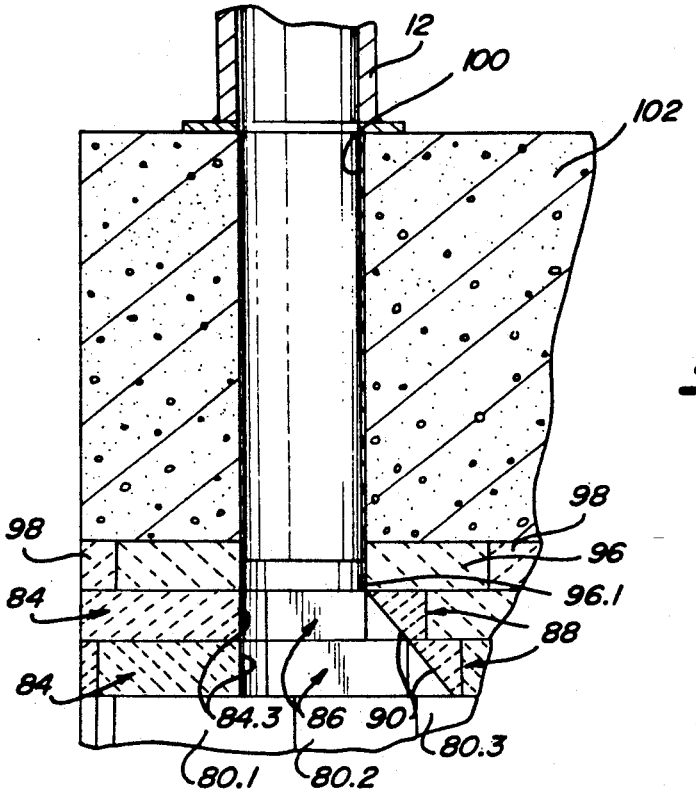
FIG. 21 is a section taken generally along the line 21—21 in FIG. 20, but showing the standpipe in full lines.
Figure 20:
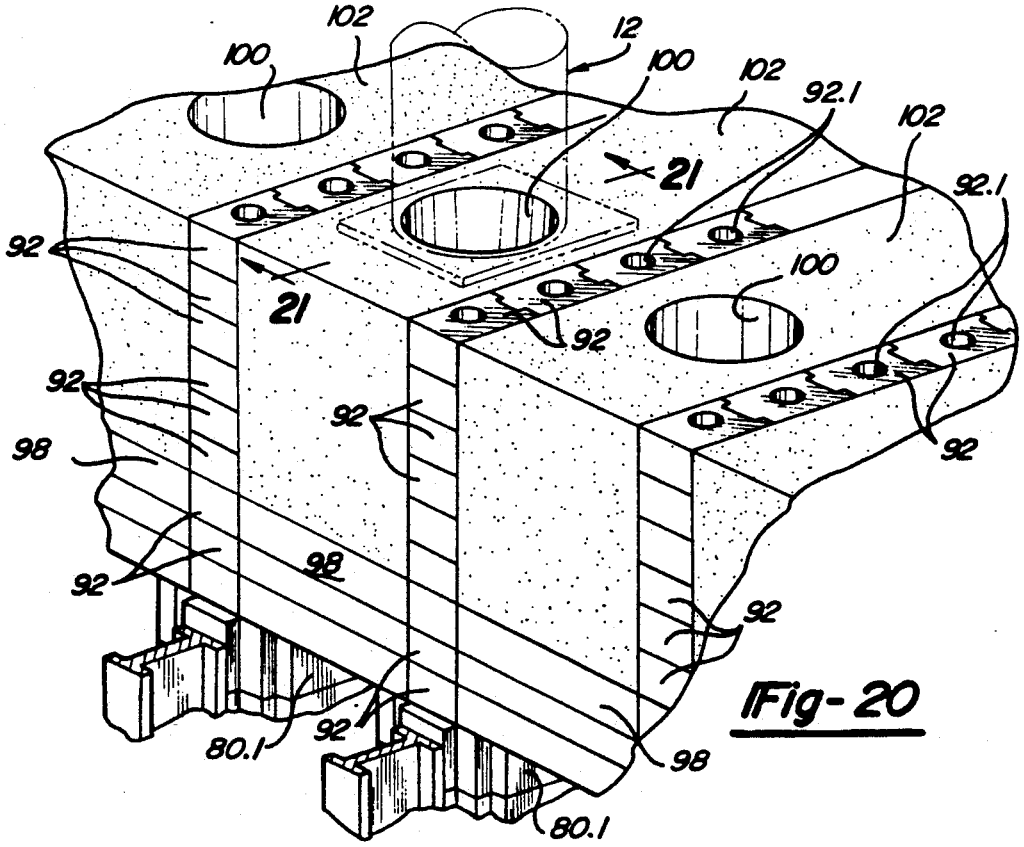
FIG. 20 is a perspective view showing a complete roof assembly with a castable refractory poured between the inspection port modules and the fiber tube shown in exploded view in FIG. 18 and further showing a standpipe in phantom.

The top of the heating wall is finished off by adding a third design of large size cast repair modules, the third large size cast modules being indicated generally at 80. As can best be seen from FIG. 7, instead of utilizing a three flue module, a two flue module 80.1 may be employed along with additional one flue modules 80.2, 80.3. Each of the modules has side walls (no reference numeral) spaced away from each other the same distance as are the side walls 54 and 70 and additionally it has upper and lower horizontal surfaces spaced away from each other a distance equal to one course of old brickwork as are the horizontal surfaces 74 of the second repair modules. The two flue third large size cast repair module 80.1 is provided with an end which is adapted to abut against a buckstay. As shown, the two flue third large size module 80.1 is provided with a pair of inspection holes 82 which are spaced apart a distance equal to the distance between the nozzles 30. The right-hand end, as viewed in FIG. 7, is provided with a notch for receiving a projection from a second one flue third large size cast repair module 80.2. An end third large size cast repair module 80.3 is provided, this module not being provided with a notch at its right-hand end. The lower surfaces of the third large size cast repair modules 80 are provided with tongues 64 which are adapted to be received within the grooves 64 on the second large size cast repair modules. However, the upper surface is flat. As can be seen from FIG. 7, it is not necessary to provide a face casting 58 in this course as the end of repair third large size cast repair module will rest directly upon the tie-in modules in the course below.

After the heating walls have been repaired to the ceiling height, the top third cast repair module having its upper surface essentially at the level of the ceiling. If the roof portion has been removed, it is now necessary to rebuild the roof portion of the coke oven battery, not only above the heating wall that has been repaired but between that heating wall and other adjacent heating walls. The process of rebuilding the roof is illustrated in FIGS. 9 through 21, and it should be noted that new cast modules have been developed for the formation of the roof. Thus, a first set of interfitting ceiling repair modules are provided which have a height approximately equal to one course of old brickwork. This first set includes a first large size generally rectangular bridging ceiling repair module indicated generally at 84. The bridging module has opposed parallel side walls 84.1 spaced apart a distance greater than the width of a coking chamber but less than the sum of the widths of a coking chamber and a heating wall. The bridging module further includes opposed end walls 84.2. One of the end walls is provided with a semicircular cut-out 84.3 which will form a portion of a passageway for the passage of gases from the coking chamber to a standpipe which is to be disposed above the semicircular cut-out. The first set of ceiling repair modules further includes first and second large size opposed cross-shaped ceiling repair modules indicated generally at 86. Each of these modules is adapted to rest upon the top surface of the third large size cast repair modules 80.1, 80.2 and they will extend slightly above the heating chamber. These cross-shaped modules 86 will cooperate with the first generally rectangular module 84 which has a semicircular cut-out to continue to form a passageway for the escape of gases from the coking chamber to the standpipe. The first set of interfitting ceiling repair modules is completed by a block ceiling repair module 88 which has opposed parallel side walls spaced apart a distance greater than the width of the coking chamber but less than the sum of the widths of a coking chamber and a heating wall, the repair module 88 having an end wall provided with a sloping surface 90 which is adapted to form a surface for the passageway which will lead from the coking chamber to a standpipe. The modules 84, 86, and 88 may be made from the same mix as modules 40, 50, 68, and 80. However, they may be made from a mix which is not as abrasion resistant, but which in other respects is essentially the same. Cooperating with each course of ceiling repair modules are additional flue modules 92. Each of the flue modules is provided with an aperture 92.1 which may be placed in alignment with a corresponding aperture 82 in one of the third large size cast repair modules. In addition, each cross-shaped module 86 may further be provided with other apertures 86.1 which may also be placed in alignment with corresponding apertures 82 in the third large size cast repair module 80.

As can be seen from an inspection of FIGS. 11, and 13 through 22, two courses of ceiling repair modules of the design set forth above are utilized. After these two courses have been laid, a second set of interfitting ceiling repair modules may be utilized, each of which includes a generally rectangular apertured ceiling repair module 96 which is adapted to be placed over the bridging module 84, the cross-shaped modules 86, and the block ceiling repair module 88 with a portion of the circular aperture 96.1 in the rectangular apertured ceiling repair module 96 being in alignment with the semicircular cut-out of the first rectangular bridging module 84 to provide for a passageway for coke oven gases. Spacer modules 98 may be provided to either end of the module 96 and, in addition, flue modules 92 are provided to complete the course.

The balance of the roof may now be completed by laying up additional courses of flue modules 92 until the last course is flush with the top of the roof of the battery. A fiber tube 100 is placed in position so that it extends slightly into the circular aperture in the rectangular aperture block 96 and then suitable material may now be poured into the space. It should be noted that as this material is not subject to either abrasion or to compressive loads that a number of suitable materials may be selected. However, as the fiber tube 100 is only used as a mold which will be consumed during the operation of the oven, it is necessary that the material 102 will mold to the desired shape and that once it has achieved its desired shape that it will retain its shape without undue expansion or contraction during operation. A number of suitable materials are well known in the art and in addition to the material set forth above, another suitable material may be Thermbond 2800-60 made by Stellar Materials, Inc. When the repair is completed, a standpipe 12 will be added, the ports or openings 92.1 in the flue modules will be closed with a suitable removable closure device, typically a cast iron cover. It will now be possible to reinstall the buckstay which was removed during the repair, the door frame, the door, and also to remove the bulkhead 38 and the insulation material.

Figure 28:
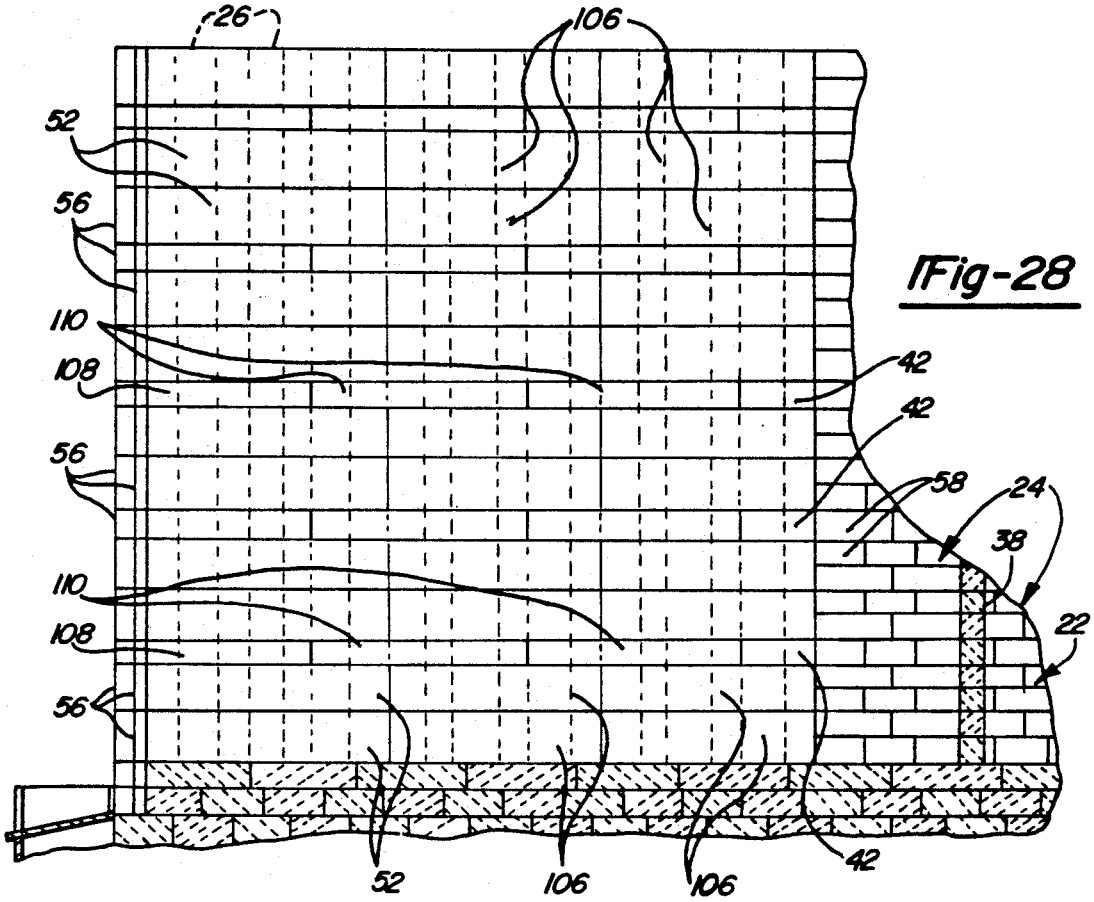
FIG. 28 is a side elevational view showing a ten flue repair.

While a specific four flue repair has been described in detail, it should be noted that the various blocks to be utilized will be made according to battery requirements for repair and that the repair may consist of a one flue repair to a complete through wall repair. Repair modules are stacked one on another without staggering the joints for one to four flue repairs. When laying up modules for a five or more flue repair, the modules are laid up with two courses of taller modules and one course of shorter cast modules as shown in the seven and ten flue block profiles shown in FIGS. 25 and 28, respectively. This type of pattern would be used for any repair that is more than four flues. "Taller" modules are those modules which have a top horizontal surface to bottom horizontal surface dimension equal to two course of old brickwork. "Shorter" modules are equal to only one course of old brickwork in height.

Figure 23:
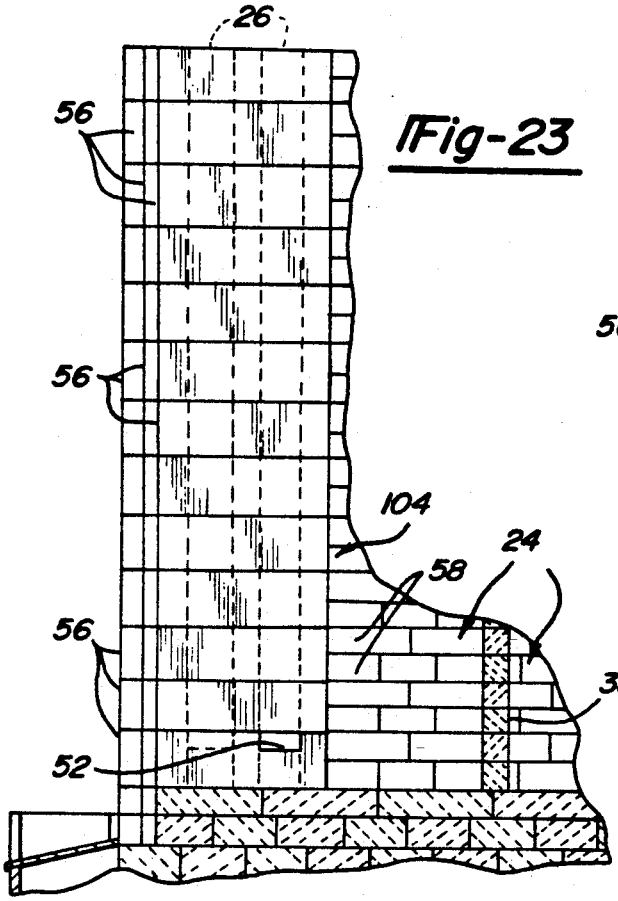
FIG. 23 is a side elevational view of a portion of a heating wall showing the manner in which it would be repaired if only a three flue end repair were being done instead of the four flue end repair shown in FIGS. 2 through 20.
Figure 24:
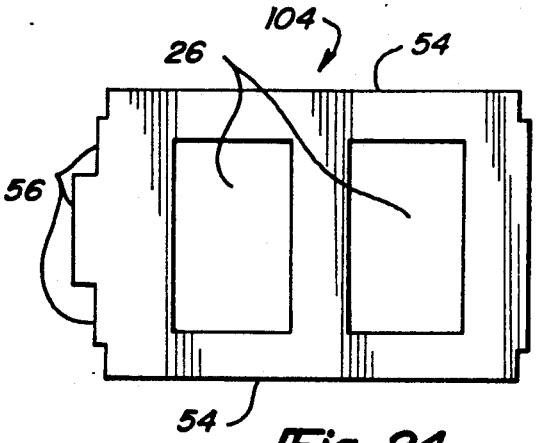
FIG. 24 is a plan view of the large size two flue cast repair module which will be used in the three flue repair shown in FIG. 23.
Figure 29:
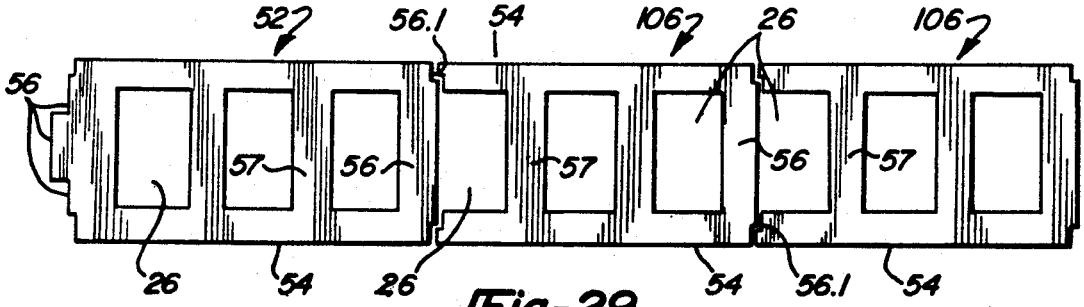
FIGS. 29 and 30 are plan views of two separate courses of large size cast repair modules which may be utilized in the ten flue repair shown in FIG. 28, FIG. 29 representing the principal repair modules, and FIG. 30 representing the tie-in repair modules.
Figure 30:
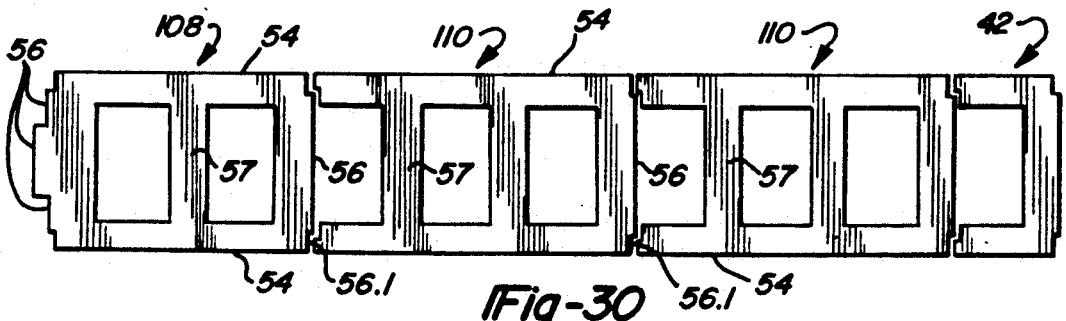

When a three flue repair is to be made as shown in FIGS. 23 and 24, the first large size cast refractory repair module 104 will have the cross-sectional configuration shown in FIG. 24. These modules will be laid up in the manner shown in FIG. 23 with suitable tie-in face castings 58. When doing a seven flue repair, cast modules of the type shown in FIGS. 25, 26, and 27 will be utilized. Thus, as can be seen, at the buckstay end of the repair, first large size cast refractory repair modules 40 and 50 will be utilized, these modules being of the same type as utilized in the repair illustrated in FIGS. 2, 3, and 4. A further large size module such as that shown at 106 will also be utilized, this form of block having a cross-sectional configuration similar to that of modules 40 and 50 except that the left-hand end portion which would abut against the buckstay is eliminated and the flue formed between the side walls 54 and the left-hand partition 60 is left open. This is because the right-hand end of the casting 40 or 50 will form the left-hand wall portion for the fourth flue. When using the tie-in course, which has a short height equal to only one course of old brickwork, a large size two flue casting 108 is employed, this casting having the same cross-section as the two flue casting shown in FIG. 24, a short large size three flue casting 110 of the configuration shown in FIG. 26 will be employed, and a further large size one flue casting 42 will be employed. It should be noted that the casting 42 is considered a large size casting in that it has a width equal to the width of the heating wall, a length equal to at least one flue, and a height at least equal to one course of old brickwork. When making a ten flue repair, various of the shapes which have been previously described will be put together in the manner indicated in FIGS. 28 through 30.

It should be obvious from the description set forth above that applicant has invented a new and improved system for repairing coke ovens. Thus, applicant has developed an improved process for making large size castings or repair modules which can have specific shapes which will reduce the time and cost of repairing a coke oven and which will additionally reduce coke oven emissions.

While preferred forms of this invention have been illustrated and discussed above, as well as preferred method of making large size cast modules, it should be appreciated that other variations may occur to those having ordinary skill in the art. Therfore, applicant does not intend to be limited to the particular details illustrated and described above.

What is claimed is:

1. A process for making a large size cast monolithic refractory repair module from a refractory mix, the large size module having high dimensional stability, good compressive loading, and good thermal shock resistance in a range of 0 to 2850 degrees Fahrenheit; comprising the following steps:

selecting a refractory mix which, when prepared and suitably cast, produces small size structures having characteristics of high dimensional stability, good compressive loading, and good thermal shock resistance in a range of 0 to 2850 degrees Fahrenheit;

mixing the refractory mix to uniformity with 0.96 ounces of water per pound of refractory mix plus or minus 10% to form a mixed material of a desired wetness;

pouring the mixed material into a large size mold until the mold is filled;

vibrating the mold and the mixed material within it;

letting the mixed material initially set into a molded material; and firing the molded material after it has taken an initial set at progressively higher temperatures from ambient to a temperature of approximately 800 degrees Fahrenheit for a time period of approximately 60 hours to form the large size cast monolithic refractory repair module having high dimensional stability, good compressive loading, and good thermal shock resistance in the range of 0 to 2850 degrees Fahrenheit.

2. The process as set forth in claim 1 wherein the molded material is fired by initially bringing the temperature of the molded material from ambient to a temperature slightly below the boiling temperature of water, the molded material being held at this temperature until the temperature within the molded material is stabilized for a period of time, the temperature of the molded material then being slowly raised to a temperature about 150° Fahrenheit above the boiling temperature of water but below the temperature at which the molded material is sintered or ceramically bonded, holding the molded material at this temperature for a period of time sufficient to drive out all free water, and then completing the firing of the molded material to form the cast refractory module.

3. The process as set forth in claim 1 wherein the molded material is fired by initially bringing the temperature of the molded material from ambient to 200° Fahrenheit, the molded material being held at 200° Fahrenheit for approximately 19 hours from commencement of firing, the temperature of the molded material then being raised progressively for 8 hours to a temperature of 360° Fahrenheit, the molded material then being held at this temperature for a further 16 hours, the temperature of the molded material then being progressively raised for 10 hours to a temperature of 520° Fahrenheit and then the temperature of the molded material being raised to a temperature of 800° Fahrenheit during a period of 5 hours to form the cast refractory module.

4. The process as set forth in claim 1 wherein 52 to 58 ounces of water are used per 55-pound bag of mix used.

5. The process as set forth in claim 1 wherein 44 to 48 ounces of water are used per 50-pound bag of mix used.

* * * * *